US011492169B2

(12) United States Patent
Rashiti

(10) Patent No.: US 11,492,169 B2
(45) Date of Patent: Nov. 8, 2022

(54) FOLDING CARTON COMPRISING A TRAY WITH A LID

(71) Applicant: AR Packaging GmbH, Kriftel (DE)

(72) Inventor: Hekuran Rashiti, Weinfelden (CH)

(73) Assignee: AR Packaging GmbH, Kriftel (DE)

( * ) Notice: Subject to any disclaimer, the term of this patent is extended or adjusted under 35 U.S.C. 154(b) by 0 days.

(21) Appl. No.: 17/462,110

(22) Filed: Aug. 31, 2021

(65) Prior Publication Data

US 2022/0063861 A1 Mar. 3, 2022

(30) Foreign Application Priority Data

Aug. 31, 2020 (DE) ..... 20 2020 105 003.6

(51) Int. Cl.

| | |
|---|---|
| ***B65D 5/20*** | (2006.01) |
| ***B65D 5/66*** | (2006.01) |
| ***B65D 5/32*** | (2006.01) |
| ***B65D 5/42*** | (2006.01) |

(52) U.S. Cl.

CPC ..... *B65D 5/321* (2013.01); *B65D 5/2009* (2013.01); *B65D 5/4266* (2013.01); *B65D 5/66* (2013.01); *B65D 5/6697* (2013.01)

(58) Field of Classification Search

CPC ..... B65D 5/66; B65D 5/6697; B65D 5/321; B65D 5/2009; B65D 5/5206

USPC ..... 229/122.27–122.3, 125.01, 125.07, 229/125.08; 206/45.2, 45.24

See application file for complete search history.

(56) References Cited

U.S. PATENT DOCUMENTS

| | | | | |
|---|---|---|---|---|
| 2,326,281 A | | 8/1943 | Becker | |
| 2,527,159 A | | 10/1951 | Kells et al. | |
| 2,628,012 A | * | 2/1953 | Goldsholl | B65D 5/6697 229/152 |
| 3,122,299 A | * | 2/1964 | Haas | B65D 5/6697 229/172 |
| 6,843,408 B1 | * | 1/2005 | Agren | B65D 5/301 229/172 |

(Continued)

FOREIGN PATENT DOCUMENTS

| | | | |
|---|---|---|---|
| FR | 1578742 A | * | 8/1969 |
| GB | 1083059 | | 9/1967 |
| GB | 1083059 A | * | 9/1967 |

OTHER PUBLICATIONS

EP 21193255.3; filed Aug. 26, 2021; European Search Report dated Feb. 9, 2022 (7 pages).

*Primary Examiner* — Nathan J Newhouse
*Assistant Examiner* — Phillip D Schmidt
(74) *Attorney, Agent, or Firm* — Barclay Damon LLP

(57) ABSTRACT

A folding carton includes a tray with a base and at least one side, and a lid including a top at least partially covering the tray. The lid includes two connection tabs that connect to the at least one side. Two corner connection tabs each connect to one of the two connection tabs via a vertical first fold line and configured to connect to a first edge of the top via a horizontal second fold line. The top wall is opened by one of: (1) folding about the horizontal second fold lines between the corner connection tabs and the top; and (2) by folding a tuck-in tongue about a third fold line against an inside of the top and folding the top halves about a fourth fold line in the tuck-in tongue and about the vertical first fold lines between the corner connection tabs and the connection tabs.

15 Claims, 15 Drawing Sheets

(56) References Cited

U.S. PATENT DOCUMENTS

| | | | | |
|---|---|---|---|---|
| 2006/0202007 | A1* | 9/2006 | Cohen | B65D 5/68<br>229/122.34 |
| 2013/0048517 | A1* | 2/2013 | Mecchella | A45C 11/00<br>206/216 |

* cited by examiner

FOLDING CARTON COMPRISING A TRAY WITH A LID

CROSS REFERENCE TO RELATED INVENTION

This application is based upon and claims priority to, under relevant sections of 35 U.S.C. § 119, German Patent Application No. 20 2020 105 003.6, filed Aug. 31, 2020, the entire contents of which are hereby incorporated by reference.

FIELD OF TECHNOLOGY

The following disclosure relates to a folding carton comprising a tray and a lid that can be opened in various ways.

BACKGROUND

Folding cartons with a tray and various closure systems are known in various designs. Folding cartons of this kind come with single walls or buffer walls, for example. The closure systems are designed as tuck-in lids, for example. Code B40.20.82.50 in the ECMA Catalog denotes a folding carton having, single side walls, adhesive tabs at the corners, and a tuck-in lid. Code B49.21.00.51 denotes a folding carton having buffer walls, sealing delta tabs at the corners, and a tuck-in lid. In conventional folding cartons with a tray and lid, the lid can only be opened in a certain way.

Proceeding from this, the object of the invention is to provide a folding carton comprising a tray and a lid, wherein the lid has enhanced functionality.

BRIEF SUMMARY OF THE INVENTION

An embodiment of a folding carton according to the invention comprises a tray having a base wall and side walls as well as a lid having a top wall for covering the tray. The lid has two connection tabs that are connected to at least one side wall of the tray. Two corner connection tabs are connected in each case to a connection tab via a vertical first fold line and to a first edge of the top wall via a horizontal second fold line. A separation line extends perpendicularly to the first edge and divides the top wall into two top wall halves. A tuck-in tongue is connected to a second edge of the top wall opposite the first edge via a third fold line, that spans the separation line, and is divided into two (2) tuck-in tongue halves by means of a fourth fold line that extends in continuation of the separation line. As a result, the top wall can either be folded up by folding about the horizontal second fold lines between the corner connection tabs and the top wall, or can be opened outward by folding the tuck-in tongue about the third fold line against the inside of the top wall and by folding the top wall halves about the fourth fold line in the tuck-in tongue and about the vertical first fold lines between the corner connection tabs and the connection tabs.

In an embodiment of the folding carton according to the invention, the lid can be opened in two different ways. This can be done in the conventional manner by folding about the horizontal second fold lines between the corner connection tabs and the top wall. Alternatively, this can be done by folding the tuck-in tongue against the inside of the top wall and folding the top wall halves, including the tuck-in tongue halves connected thereto, about the fourth fold line in the tuck-in tongue and folding the top wall halves, including the corner connection tabs connected thereto, about the vertical first fold lines between the corner connection tabs and the connection tabs. When the top wall is closed, the edges of the top wall halves, between which the separation line extends, adjoin one another. This is also the case when the lid is opened in the conventional manner by folding about the horizontal second fold lines. However in the alternative opening method, the edges of the top wall halves that form the second edge of the top wall lie against one another when the lid is open. In addition, in this opening variant, the same sides of the top wall are oriented upward before and after opening. On account of the two different opening methods, either of which can be used, the folding carton has greater appeal, which can help with sales promotion. Furthermore, there is the possibility of printing on the top wall such that different graphic designs and/or information can be displayed and/or can be presented to the viewer in an advantageous manner on account of the different orientations of the printed matter on both top wall halves before and after opening according to the second opening method. The different displays can be adapted to the closed folding carton and the arrangement of the product inside the opened folding carton.

According to another embodiment, the top wall halves each have a diagonal fold line that extend from the end of the separation line in the first edge of the top wall to an outer end of the second edge of the top wall. The diagonal fold lines make it easier to open the lid in the second opening method, since the two top wall halves can be easily deformed along the diagonal fold lines, as a result of which the top wall can be more easily slid open.

According to an embodiment, the connection tabs are inserted into parallel first insertion slots on outer ends of a side wall of the tray. As a result, the connection tabs can be easily connected to the tray. According to another embodiment, the connection tabs are glued to at least one side wall of the tray. As a result, the connection tabs are connected to the tray in a simple and secure manner. In this case, the connection tabs can be inserted into insertion slots or glued to the outside of at least one side wall. According to another embodiment, the connection tabs lie against two parallel side walls of the tray.

According to another embodiment, the connection tabs are trapezoidal. As such, the height of the connection tabs decreases with increasing distance from the vertical first fold lines. As a result, the connection tabs can be more easily inserted into insertion slots. According to another embodiment, the connection tabs have the shape of an isosceles trapezoid.

According to another embodiment, the corner connection tabs have the shape of a right-angled trapezoid, wherein the horizontal second fold lines transition into the base sides of the trapezoid and the vertical first fold lines transition into limbs of the trapezoid that extend perpendicularly to the base sides. This produces material-saving and visually appealing corner connection tabs.

According to another embodiment, the lid can be inserted with the tuck-in tongue from above into the tray, such that the tuck-in tongue clamps securely behind a side wall of the tray. As a result, the lid can be held in the closed state of the tray. According to another embodiment, the tuck-in tongue can be inserted into a second insertion slot on the upper edge of a side wall of the tray. As a result, the tuck-in tongue can be held particularly securely on the tray. Alternatively, the tuck-in tongue may be glued to the outside of the side wall such that the lid can be opened alter the tuck-in tongue is released from the side wall. For this purpose, a lower part of the tuck-in tongue that is connected to the side wall by means of adhesive can be separated from an upper part of the tuck-in tongue along a perforation line or other line of weakness.

According to another embodiment, the tuck-in tongue has the shape of an isosceles trapezoid with a width that decreases away from the second edge of the top wall. As a result, the tuck-in tongue can be more easily inserted into the second insertion slot.

According to another embodiment, the tray is a buffer-wall tray. The configuration of the tray as a buffer-wall tray is particularly favorable to the formation of the first insertion slots and/or second insertion slot. According to another embodiment, the first insertion slots are formed in each case on a fold line between a dust flap and a side wall and another side wall that is folded against the dust flap. According to another embodiment, the second insertion slot is formed on a fold line between an outer side wall part and a horizontal upper side wall part of a baler-wall tray. According to another embodiment, the buffer-wall tray has a thumb hole that adjoins the second insertion slot. As a result, the tuck-in tongue can be more easily slid out of the second insertion slot.

According to another embodiment, the top wall has support tabs that project outward on the two lateral edges and adjoin the second edge and that lie between both connection tabs on the upper edge of the tray when the top wall is opened as per the second opening method. As a result, the opened lid is supported in the open position and can be used to receive objects, e.g. a product removed from the tray.

BRIEF DESCRIPTION OF THE DRAWINGS

The invention is explained in greater detail below based on the appended drawings of an exemplary embodiment. In the drawings:

FIG. 5 illustrates a front perspective view of the embodiment of the tray of FIG. 4 with dust flaps folded in;

FIG. 6 illustrates a front perspective view of the embodiment of the tray of FIG. 5 with additional dust flaps folded in;

DETAILED DESCRIPTION OF THE INVENTION

In the present application, the terms "at the top" and "at the bottom" as well as "horizontal" and "vertical" relate to an arrangement of the folding carton with the base wall of the tray on a horizontal substrate and with side walls pointing upward relative to the base wall, wherein the top wall is arranged above the base wall when the lid is closed.

Figure 1:
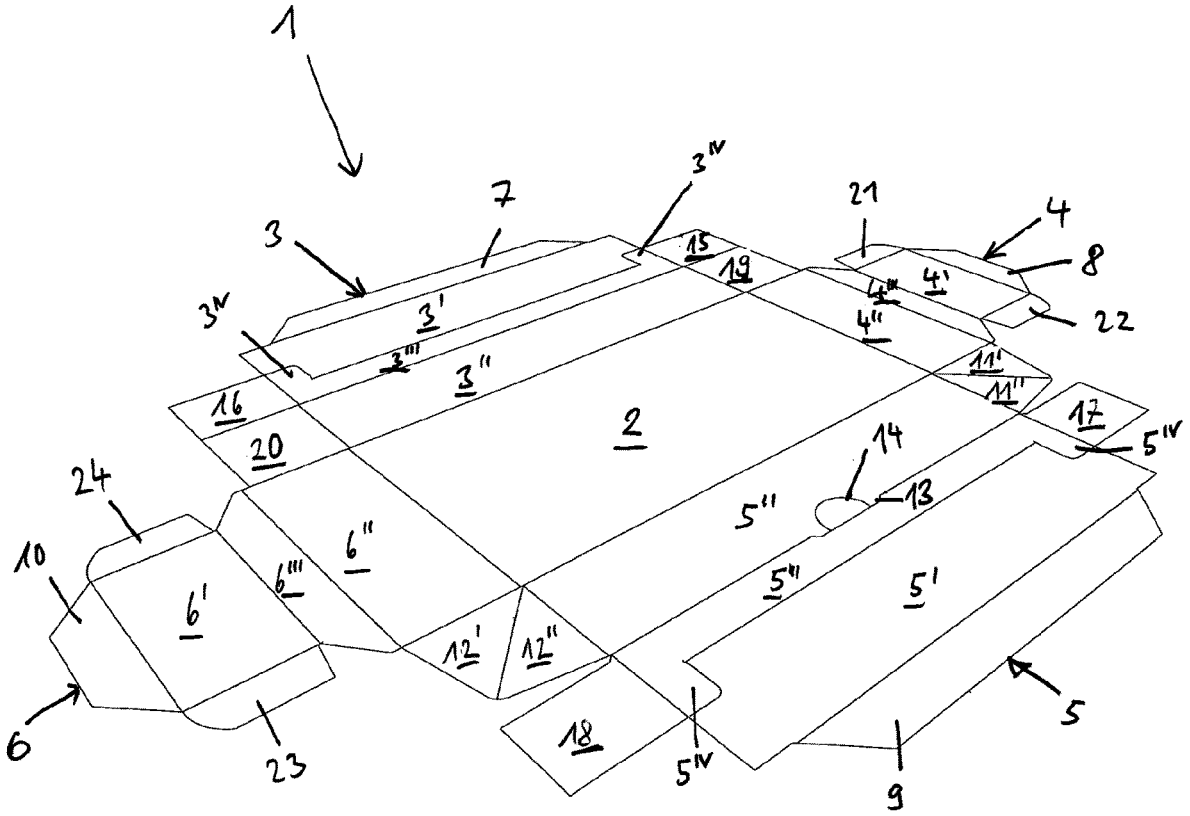
FIG. 1 illustrates a top front perspective view of an embodiment of a tray of a folding carton lying flat.

According to FIG. 1, a first blank 1 comprises a rectangular base wall 2, which is connected at its lateral edges via fold lines to side walls 3, 4, 5, 6. In order to form a buffer wall, the side walls 3, 4, 5, 6 each comprise an inner side wall part $\mathbf{3}^{I}$, $\mathbf{4}^{I}$, $\mathbf{5}^{I}$, $\mathbf{6}^{I}$ and an outer side wall part $\mathbf{3}^{II}$, $\mathbf{4}^{II}$, $\mathbf{5}^{II}$, $\mathbf{6}^{II}$, which are connected at their upper edges via fold lines to opposing edges of an upper side wall part $\mathbf{3}^{III}$, $\mathbf{4}^{III}$, $\mathbf{5}^{III}$, $\mathbf{6}^{III}$. The upper side wall parts $\mathbf{3}^{III}$, $\mathbf{5}^{III}$ each have outwardly projecting end portions $\mathbf{3}^{IV}$, $\mathbf{5}^{IV}$ at both ends that are separated from the inner side wall parts $\mathbf{3}^{I}$, $\mathbf{5}^{I}$ by means of cut lines. The inner side wall parts $\mathbf{3}^{I}$, $\mathbf{4}^{I}$, $\mathbf{5}^{I}$, $\mathbf{6}^{I}$ are connected at their lower edges via fold lines to respective base tabs 7, 8, 9, 10.

An outer side wall part 5II, which is connected to one of the two long edges of the base wall 2, is connected at its two lateral edges via triangular tabs $\mathbf{11}^{I}$, $\mathbf{11}^{II}$, $\mathbf{12}^{I}$, $\mathbf{12}^{II}$ to the lateral edges of adjacent outer side wall parts $\mathbf{4}^{I}$, $\mathbf{6}^{I}$, which are hinged via fold lines on short edges of the base wall 2. The same outer side wall part $\mathbf{5}^{II}$ has a trapezoidal projection 13 in the center of its upper edge that is separated from the adjacent upper side wall part $\mathbf{5}^{III}$ via a cut line. The same outer side wall part $\mathbf{5}^{II}$ has an approximately semi-circular thumb hole 14 in the region of the projection 13.

The upper side wall parts $\mathbf{3}^{III}$ and $\mathbf{5}^{III}$ are connected at their two lateral edges via fold lines to respective rectangular dust flaps 15, 16 and 17, 18. The outer side wall part $\mathbf{3}^{II}$ is connected at its two lateral edges via fold lines to rectangular dust flaps 19, 20. The inner side wall parts $\mathbf{4}^{I}$ and $\mathbf{6}^{I}$ are connected at their two lateral edges via fold lines to respective strip-shaped dust flaps 21, 22 and 23, 24, which each have a bevel at the top and a radius at the bottom. The blank substantially corresponds to the blank of the tray with the code B49.20.00.00 according to the ECMA Catalog.

Figure 2:
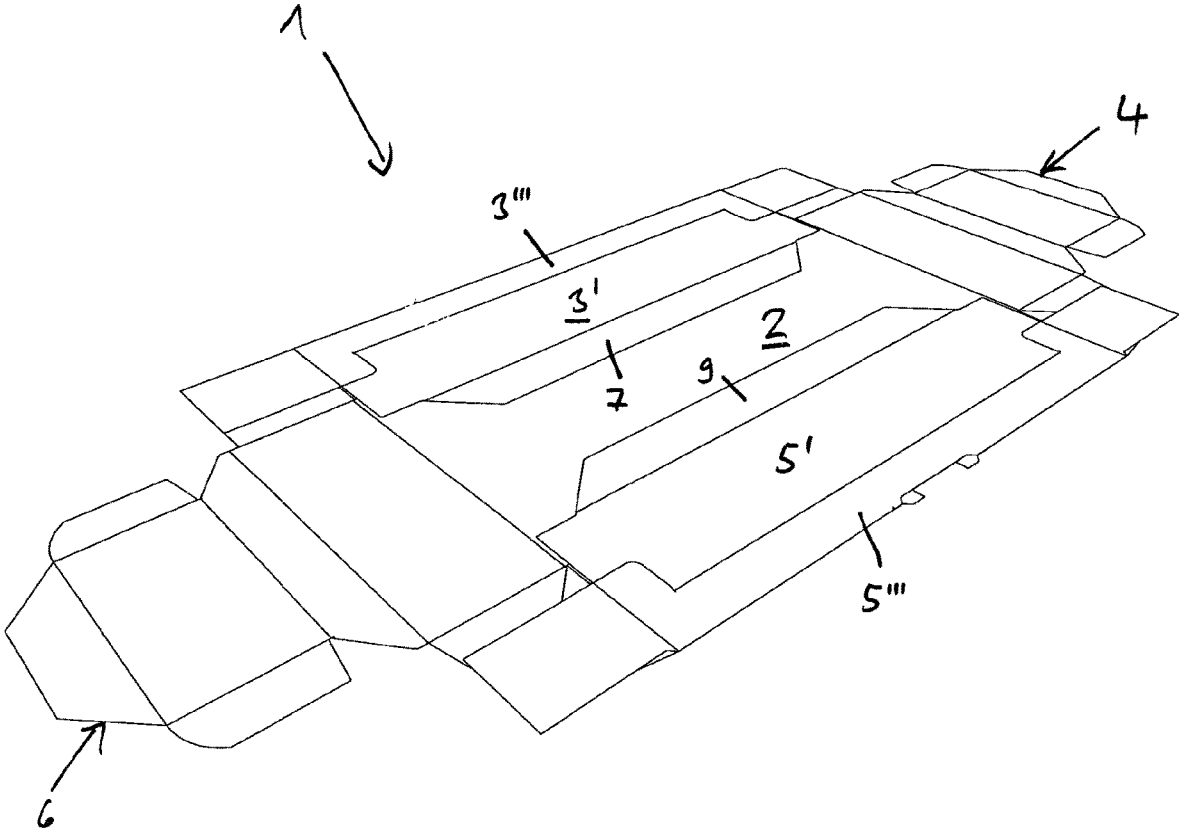
FIG. 2 illustrates a top front perspective view of the embodiment of the tray of FIG. 1 after folding two opposing side walls.
Figure 3:
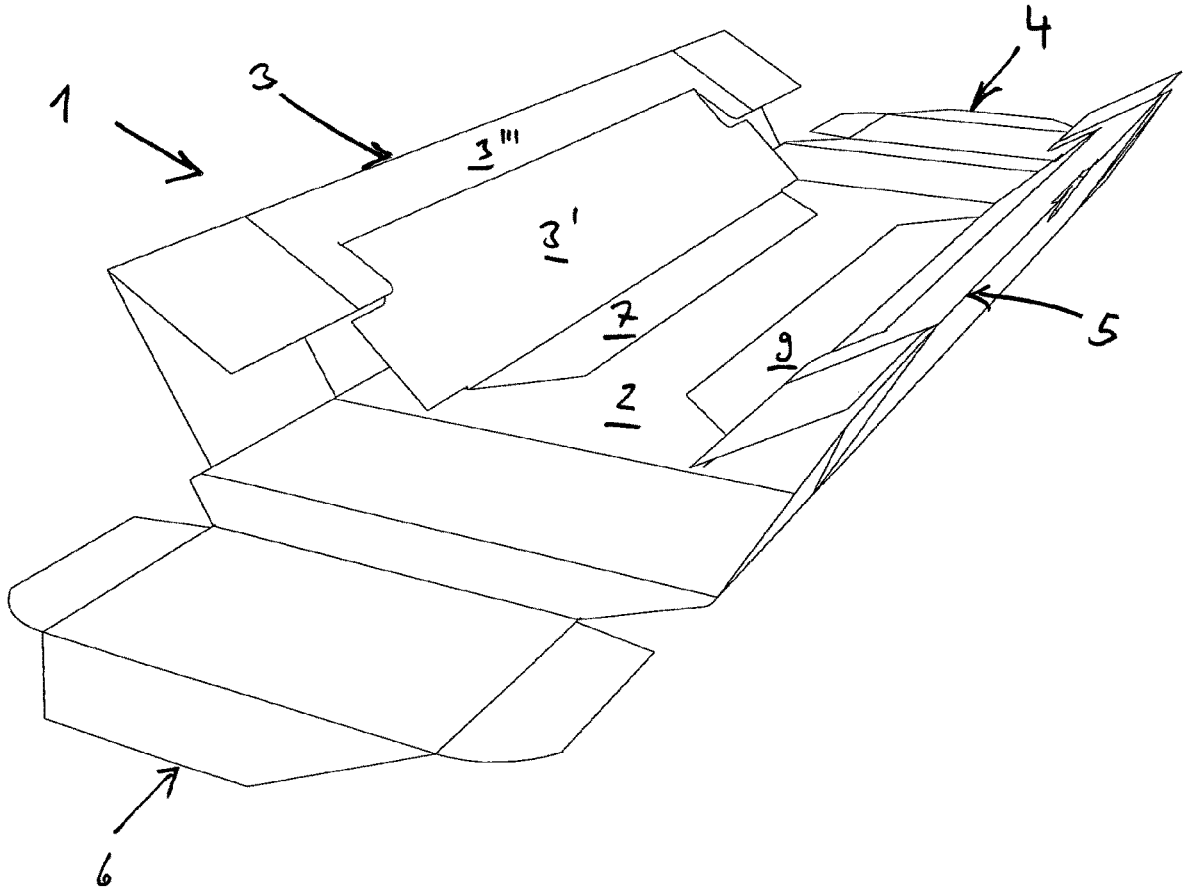
FIG. 3 illustrates a top front perspective view of the embodiment of the tray of FIG. 2 when the two opposing side walls are being set upright.
Figure 4:
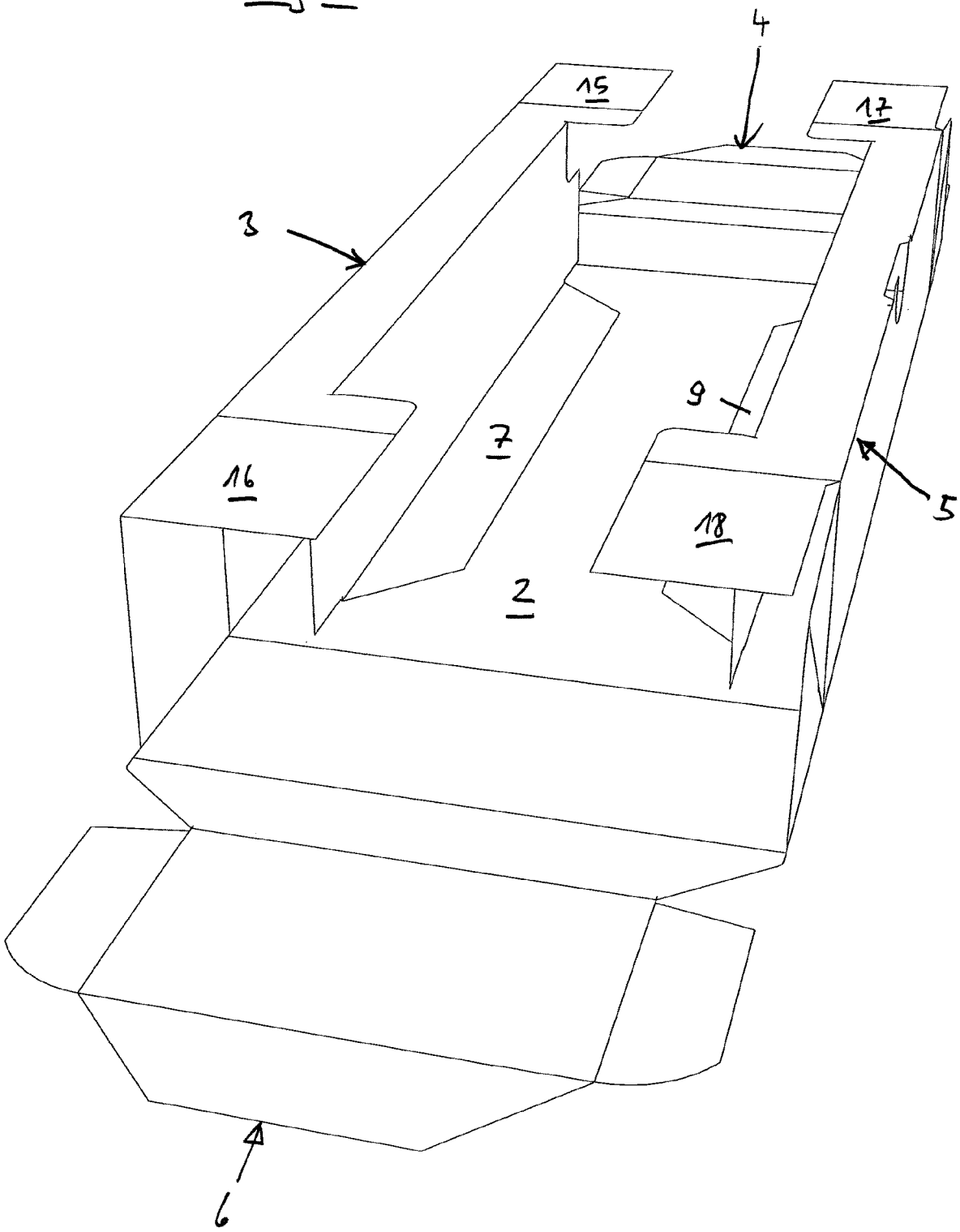
FIG. 4 illustrates a front perspective view of the embodiment of the tray of FIG. 3 with the two opposing side walls set fully upright.

According to FIG. 2, the upper and inner side wall parts $\mathbf{3}^{III}$, $\mathbf{5}^{III}$, $\mathbf{3}^{I}$, $\mathbf{5}^{I}$ are folded about their fold lines with the outer side wall parts $\mathbf{3}^{II}$, $\mathbf{5}^{II}$ against the inner sides of the blank 1. Subsequently, according to FIG. 3, the long side walls 3, 5 are set upright. They are shown in the upright state in FIG. 4. The base tabs 7, 9 are supported on the base wall 2.

Figure 5:
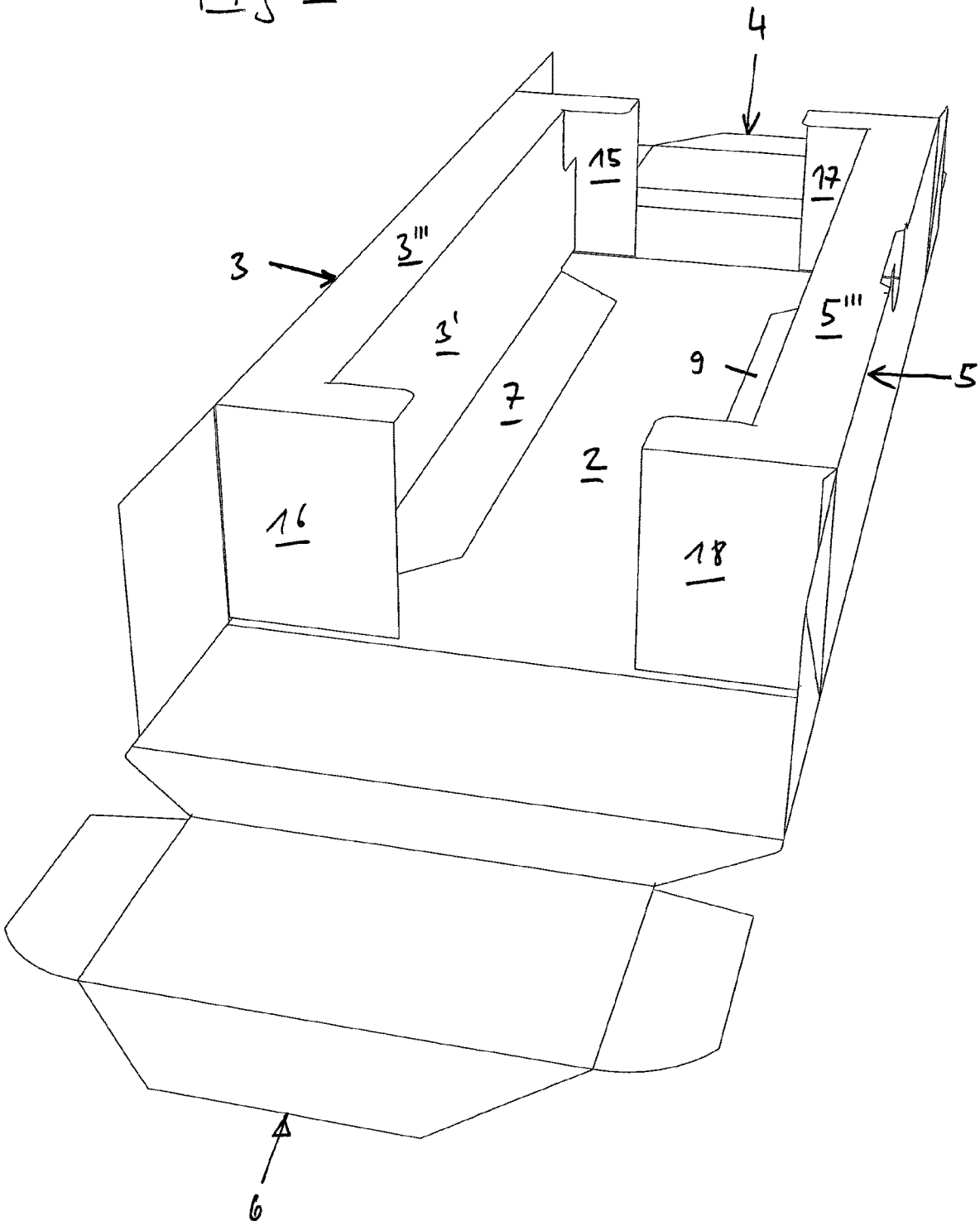
Figure 6:
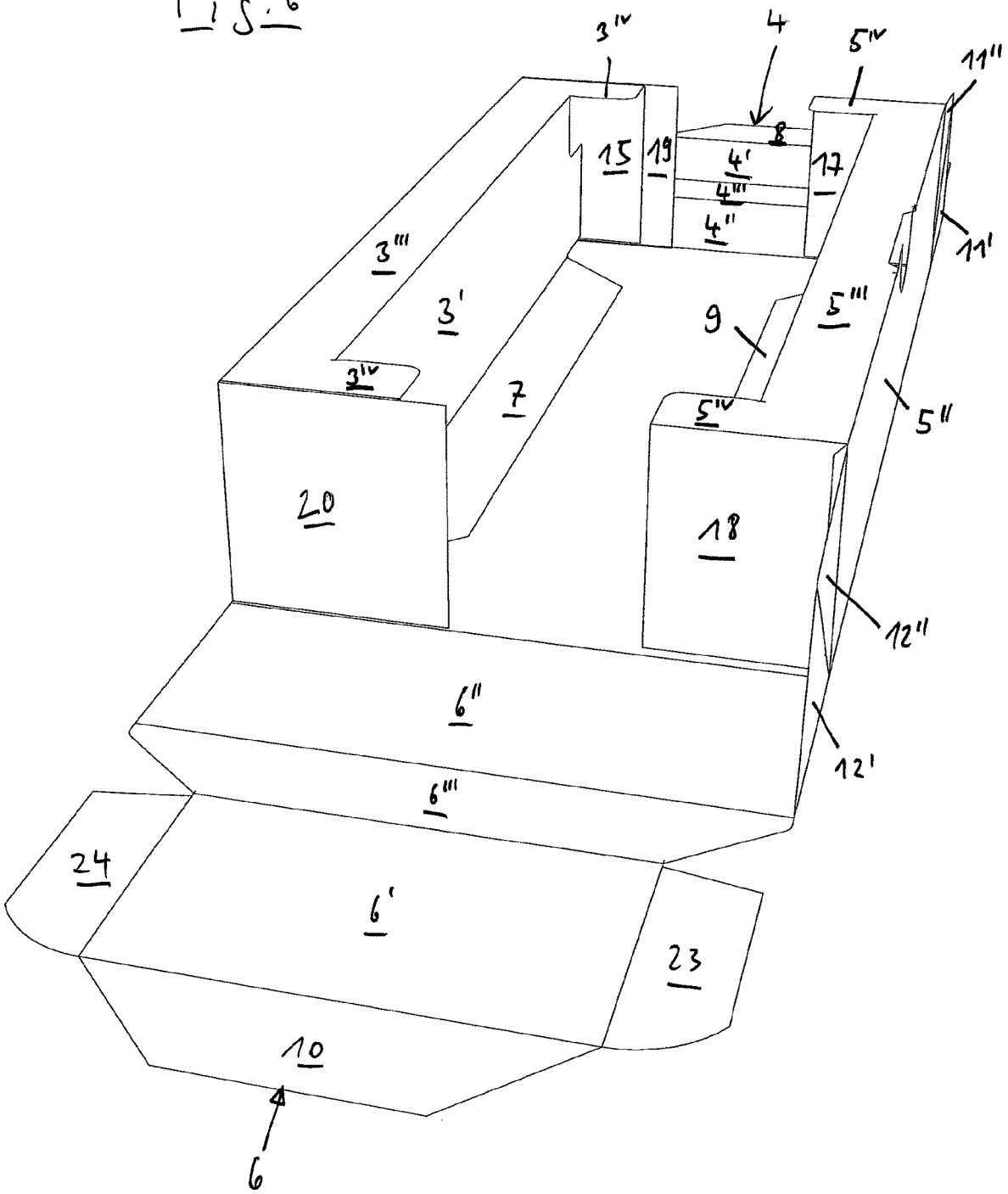

In a next step, according to FIG. 5, the dust flaps 15, 16, 17, 18 connected to the upper side wall parts $\mathbf{3}^{III}$, $\mathbf{5}^{III}$ of the long side walls 3, 5 are folded vertically downward. Then, according to FIG. 6, the dust flaps 19, 20 connected to the outer side wall parts $\mathbf{3}^{II}$, $\mathbf{5}^{II}$ of the long side walls 3, 5 are folded outward against the aforementioned dust flaps 15, 16.

Subsequently, the outer side all parts $\mathbf{4}^{II}$, $\mathbf{6}^{II}$ of the short side walls 4, 6 are folded up, wherein the triangular tabs $\mathbf{11}^{I}$, $\mathbf{11}^{II}$, $\mathbf{12}^{I}$, $\mathbf{12}^{II}$ are folded inward until they and the outer side wall parts $4^{II}$, $6^{II}$ lie against the adjacent dust flaps 17, 18. This produces first insertion slots 25, 26 between the outer side wall parts $4^{II}$, $6^{II}$ and the dust flaps 19, 20.

Figure 7:
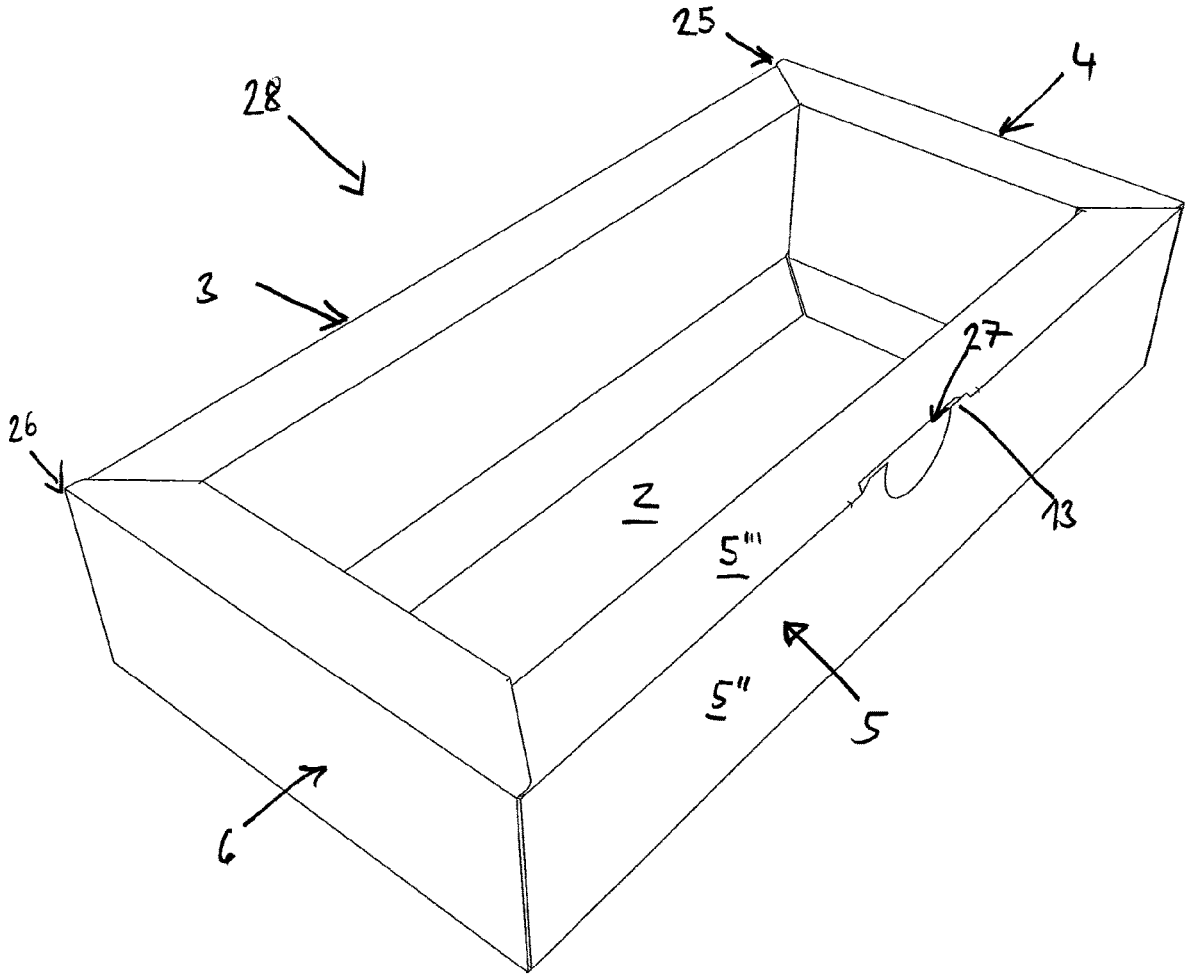
FIG. 7 illustrates a front perspective view of the embodiment of the tray of FIG. 6 set upright.

Subsequently, the upper side wall parts $4^{III}$, $6^{III}$ of the short side walls 4, 6 are folded onto the end portions $3^{IV}$, $5^{IV}$ of the upper side wall parts $3^{III}$, $5^{III}$ of the long side walls 3, 5. Finally, the inner side wall parts $4^{I}$, $6^{I}$ of the short side walls 4, 6 are folded between the long side walls 3, 5, wherein they are folded with their dust flaps 21, 23, 24 under the end portions $3^{IV}$, $5^{IV}$. The base tabs 8, 10 are folded against the upper side of the base wall 2 such that they project inward relative to the inner side wall parts $4^{I}$, $6^{I}$. In addition to the projection 13, the upper side wall part $5^{III}$ also has a second insertion slot 27. The tray 28 set upright in this manner is shown in FIG. 7.

Figure 8:
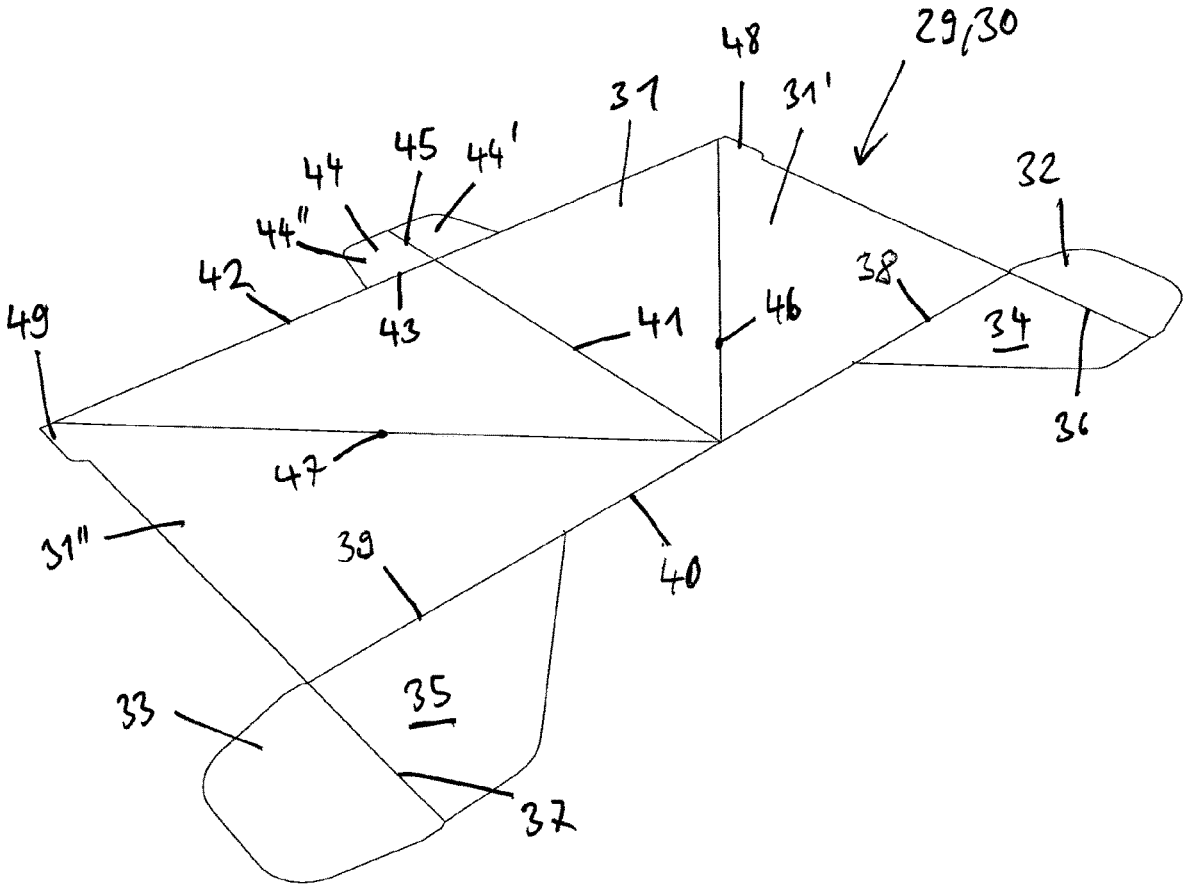
FIG. 8 illustrates a top perspective view of an embodiment of a lid of the folding carton lying flat.

According to FIG. 8, a second blank 29 of a lid 30 comprises a substantially rectangular top wall 31, two substantially trapezoidal connection tabs 32, 33 and two corner connection tabs 34, 35 in the shape of right-angled trapezoids. The connection tabs 32, 33 are connected via respective vertical fold lines 36, 37 to respective corner connection tabs 34, 35. The corner connection tabs 34, 35 are connected via respective horizontal second fold lines 38, 39 to a first edge 40 of the top wall 31.

The top wall 31 is divided in the center into two top wall halves $31^{I}$, $31^{II}$ by means of a separation line 41 that proceeds from the first edge 40. The separation line 41 extends all the way to the opposite second edge 42. The second edge 42 is connected via a third fold line 43 to a tuck-in tongue 44, which is arranged in the center of the second edge 42 and spans the separation line 41. The tuck-in tongue 44 has a fourth fold line 45 in continuation of the separation line 41 that divides the tuck-in tongue 44 into two tuck-in tongue halves $44^{I}$, $44^{II}$. The tuck-in tongue 44 is trapezoidal, wherein its width decreases with increasing distance from the second edge 42.

Furthermore, the top wall 31 has diagonal fold lines 46, 47 that extend from the interface between the separation line 41 and the first edge 40 to respective outer ends of the second edge 42. Each top wall half $31^{I}$, $31^{II}$ has an outwardly projecting support tab 48, 49 next to the end of the second edge 42 on the adjacent lateral edge.

Figure 9:
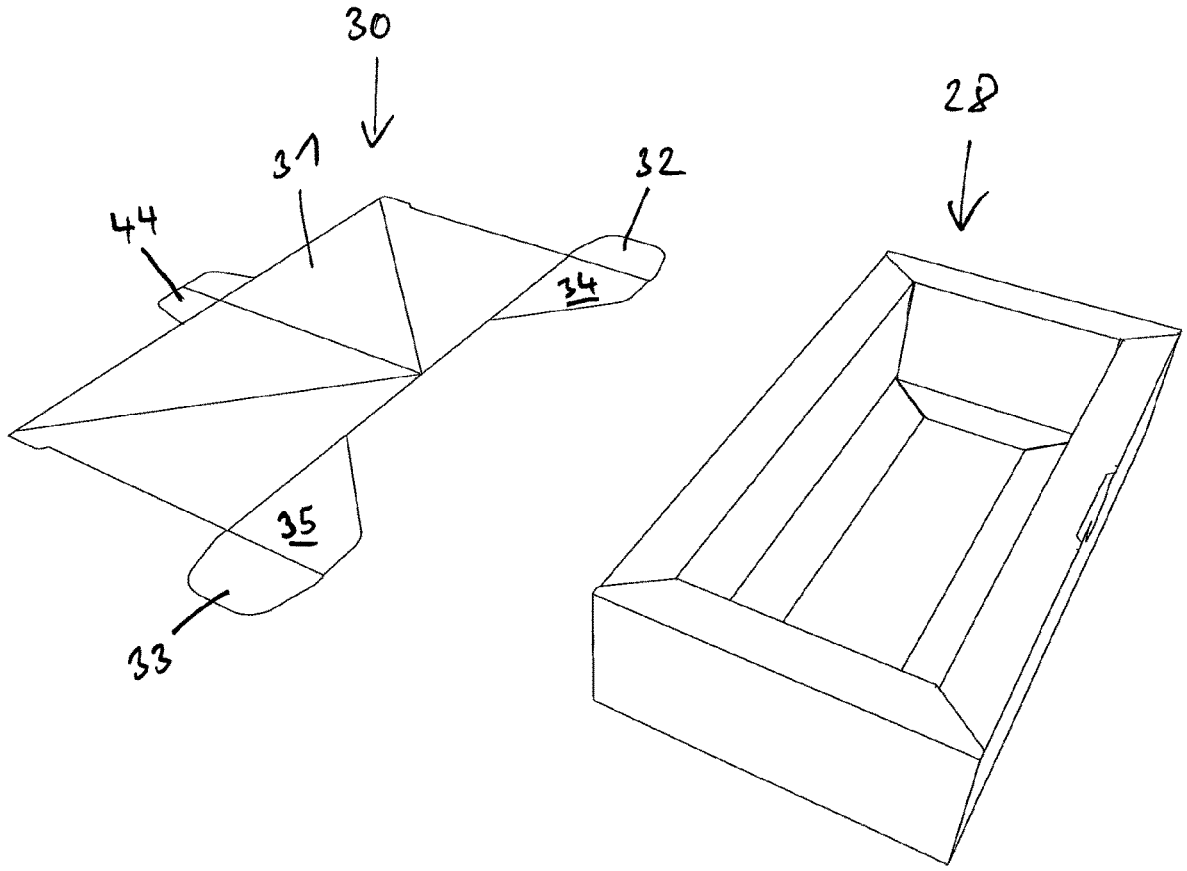
FIG. 9 illustrates a front perspective view of the embodiment of the tray from FIG. 7 and the embodiment of the lid from FIG. 8.
Figure 10:
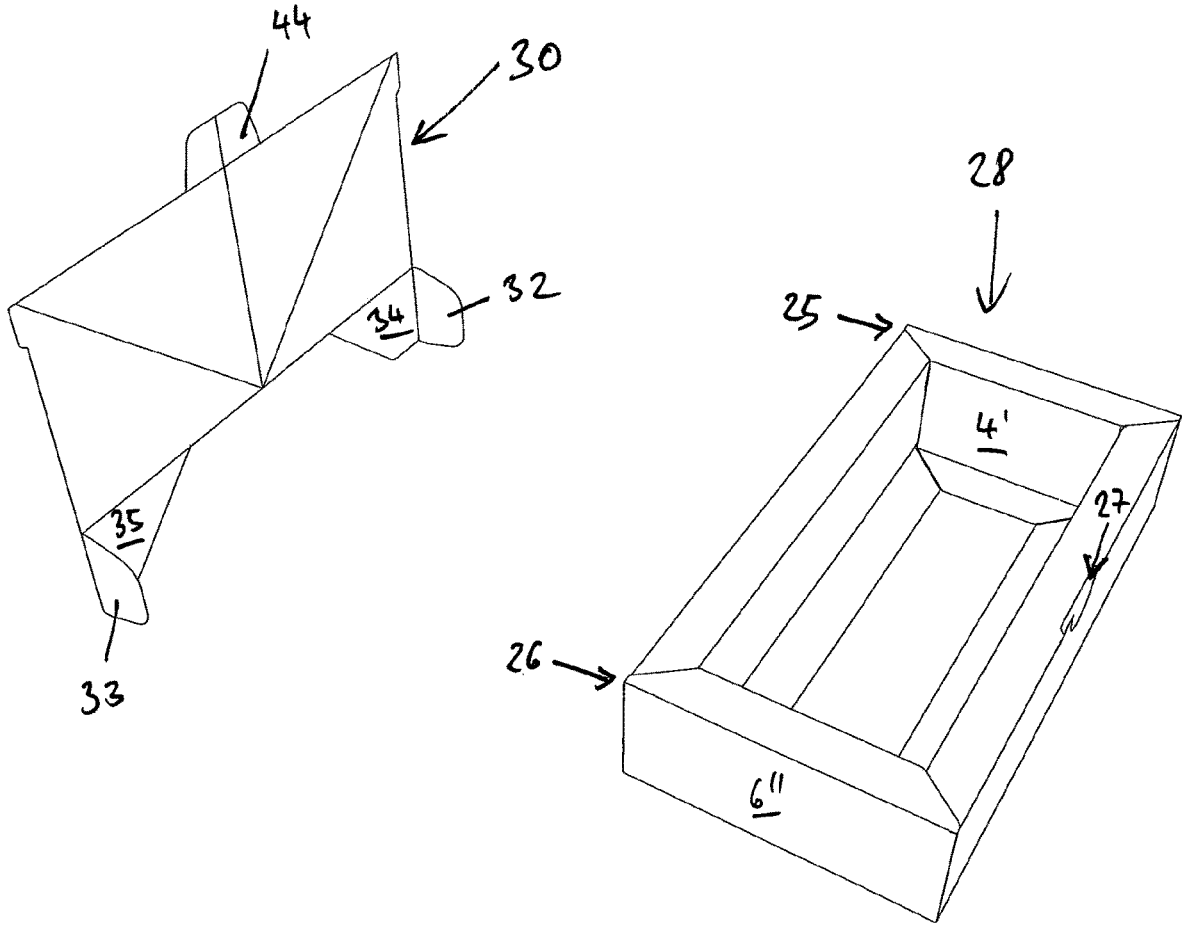
FIG. 10 illustrates a top perspective view of the embodiment of the tray from FIG. 7 and the embodiment of the lid from FIG. 8 with connection tabs angled with respect to the corner connection tabs.
Figure 11:
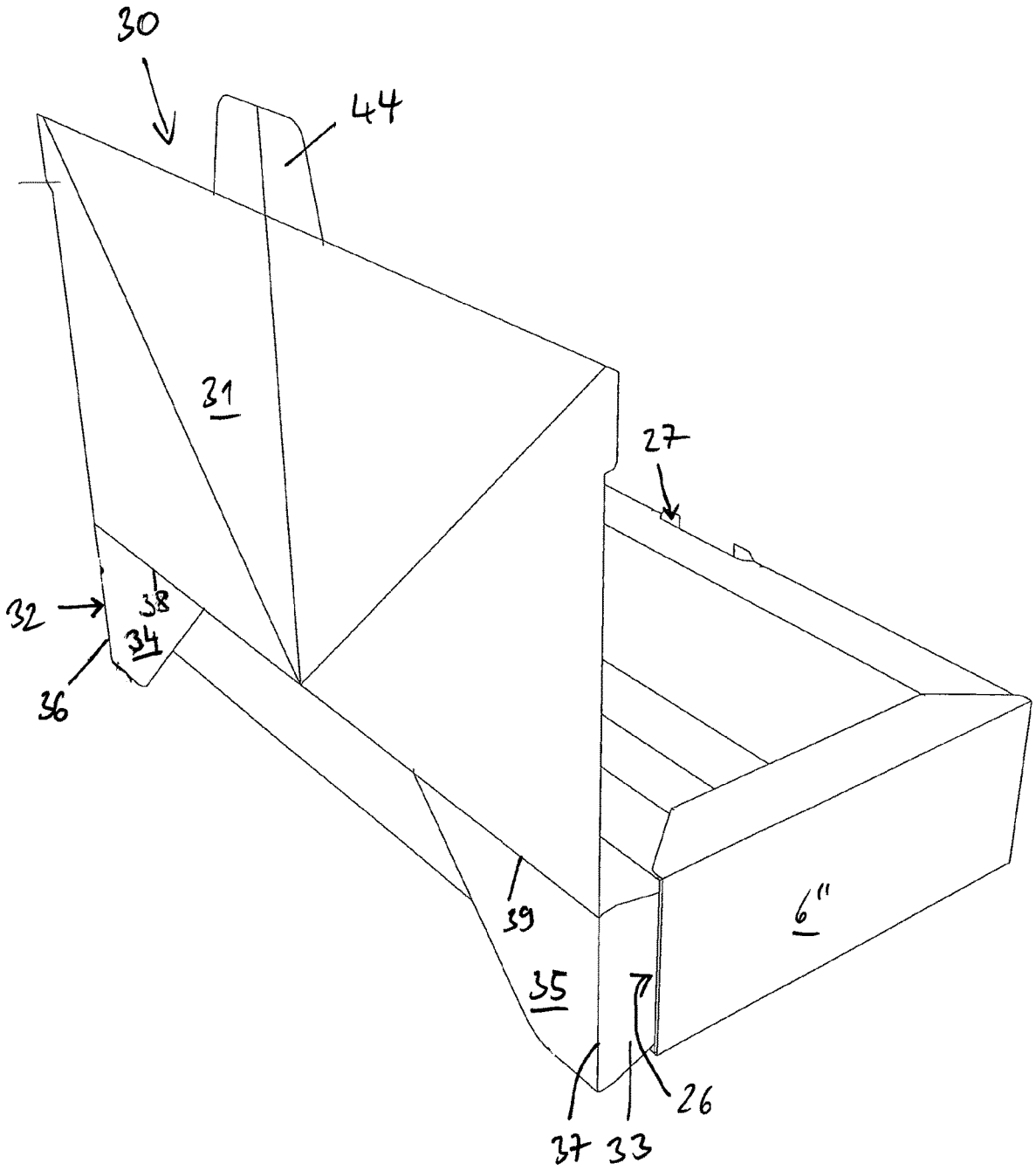
FIG. 11 illustrates a rear perspective view of the embodiment of the lid from FIG. 10 where connection tabs are being inserted into first insertion slots of the embodiment of the tray from FIG. 7.
Figure 12:
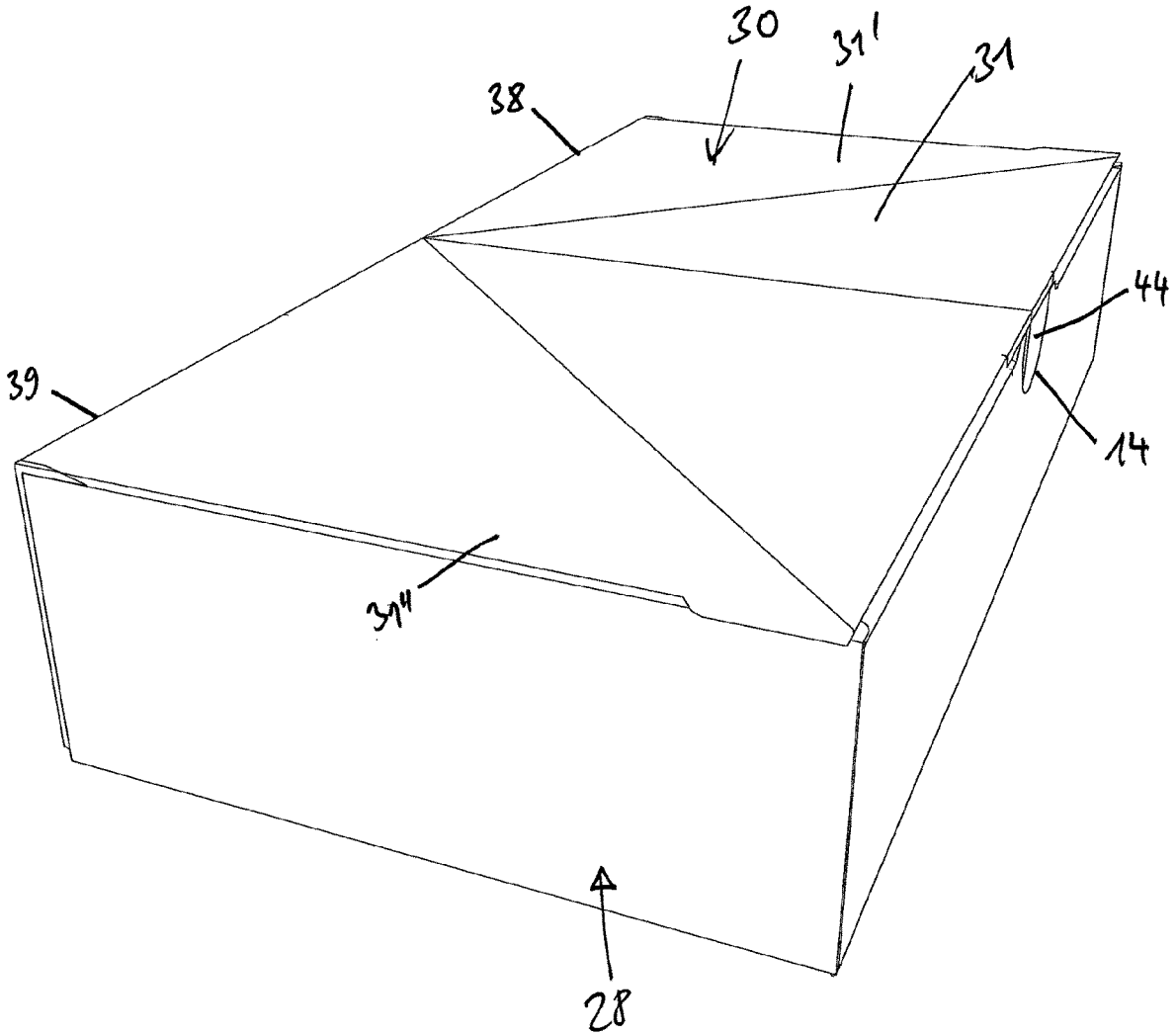
FIG. 12 illustrates a front perspective view of an embodiment of the folding carton with the lid in a closed state.

According to FIGS. 9 and 10, in order to connect the id 30 to the tray 28, the connection tabs 32, 33 are firstly folded perpendicularly with respect to the corner connection tabs 34, 35. According to FIG. 11, the lid 30 is inserted by means of the connection tabs 32, 33 into the first insertion slots 25, 26 between the dust flaps 19, 20 and the outer side wall parts $4^{II}$, $6^{II}$ of the short side walls 4, 6. According to FIG. 12, the lid 30 is closed by folding about the horizontal second fold lines 38, 39. The tuck-in tongue 44 is then inserted into the second insertion slot 27.

To open the lid 30, the tuck-in tongue 44 can be pushed out of the second insertion slot 27 using a thumb. Then, the lid 30 can be opened in the conventional manner by folding it up out of the position shown in FIG. 11 about the horizontal second fold lines 38, 39 counter to the direction for closing the lid 30.

Figure 13:
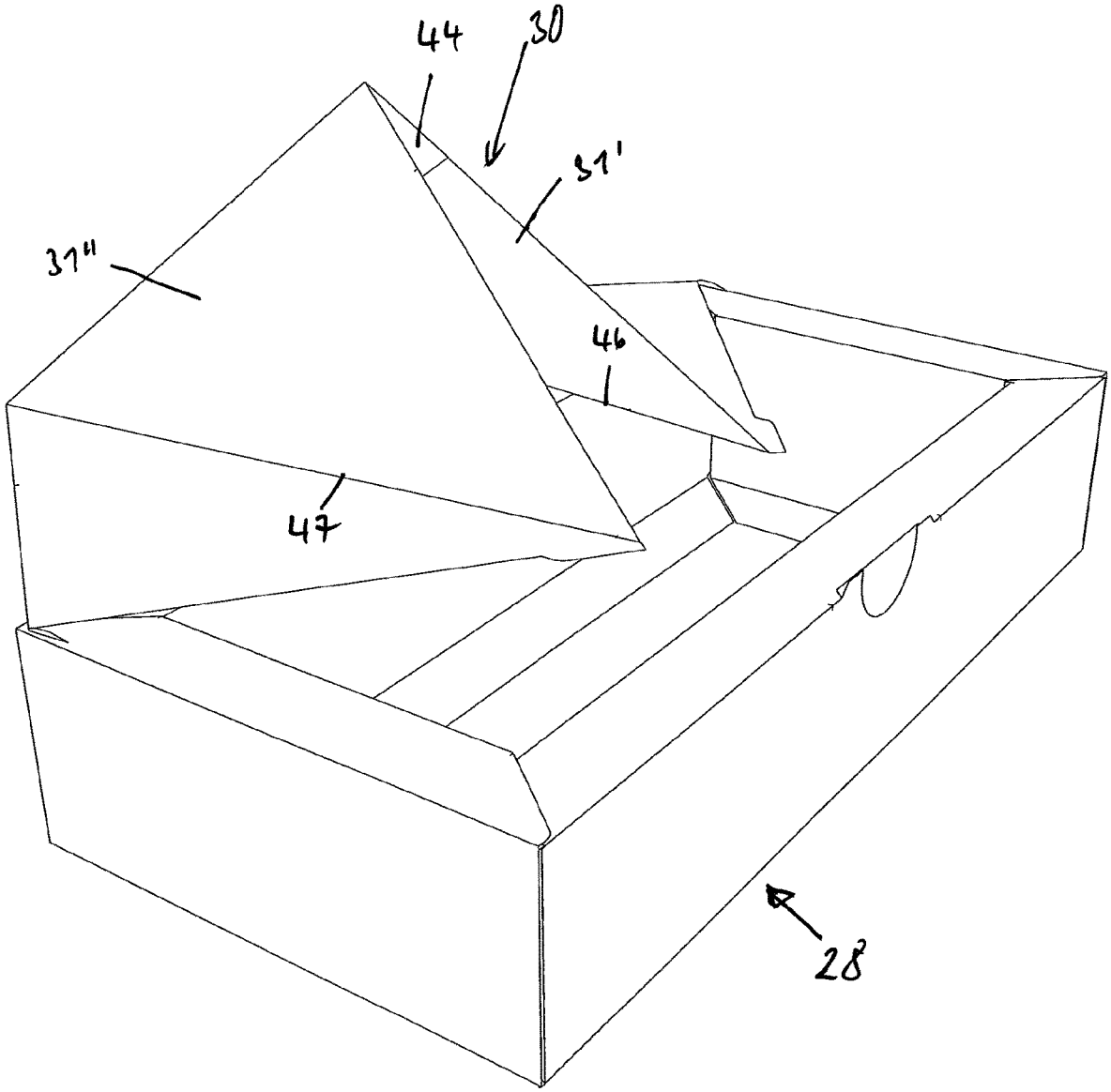
FIG. 13 illustrates a front perspective view of the folding canon with an embodiment of the lid being opened according to a second opening method.
Figure 14:
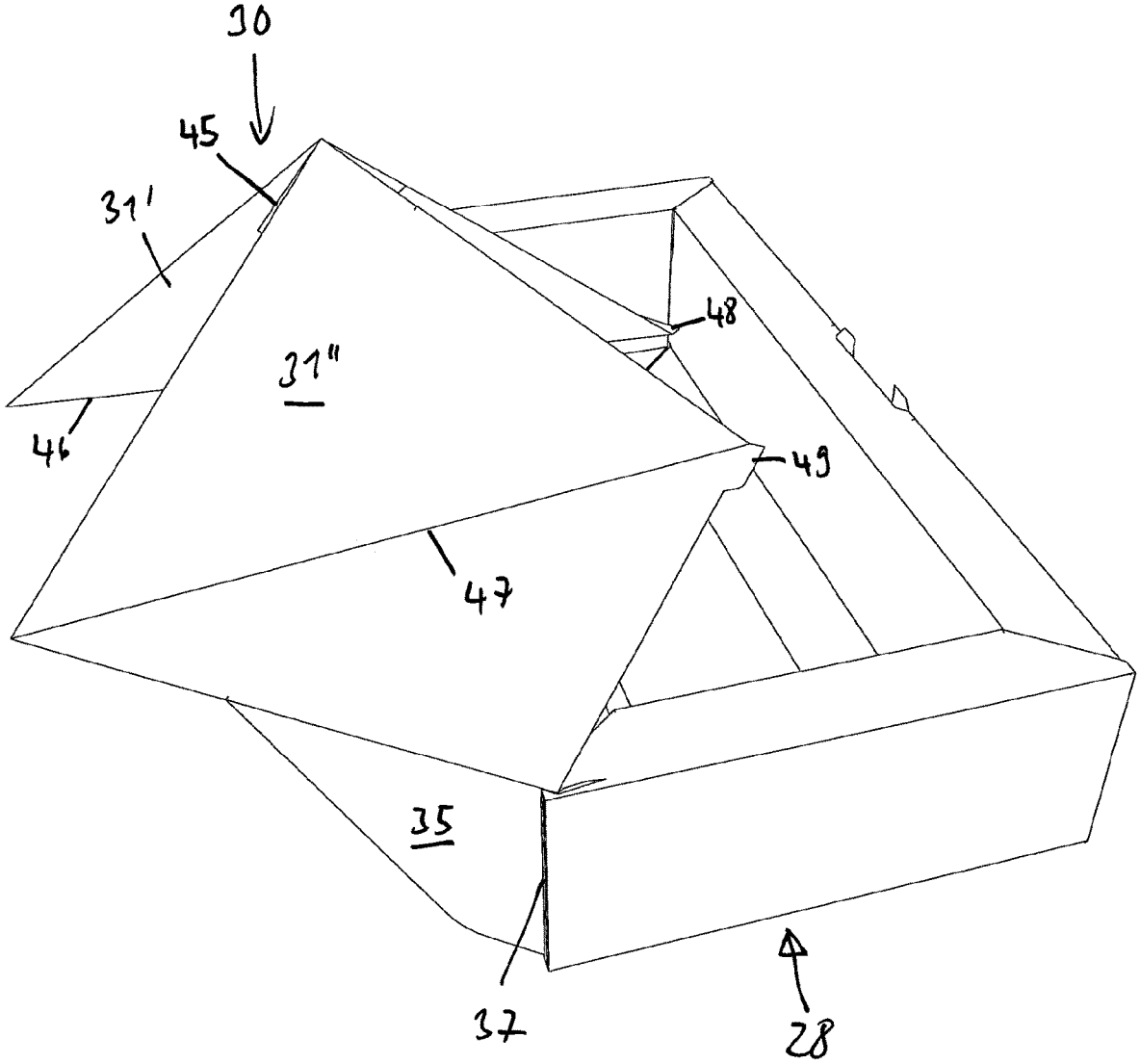
FIG. 14 illustrates a rear perspective view of the folding canon of FIG. 13.
Figure 15:
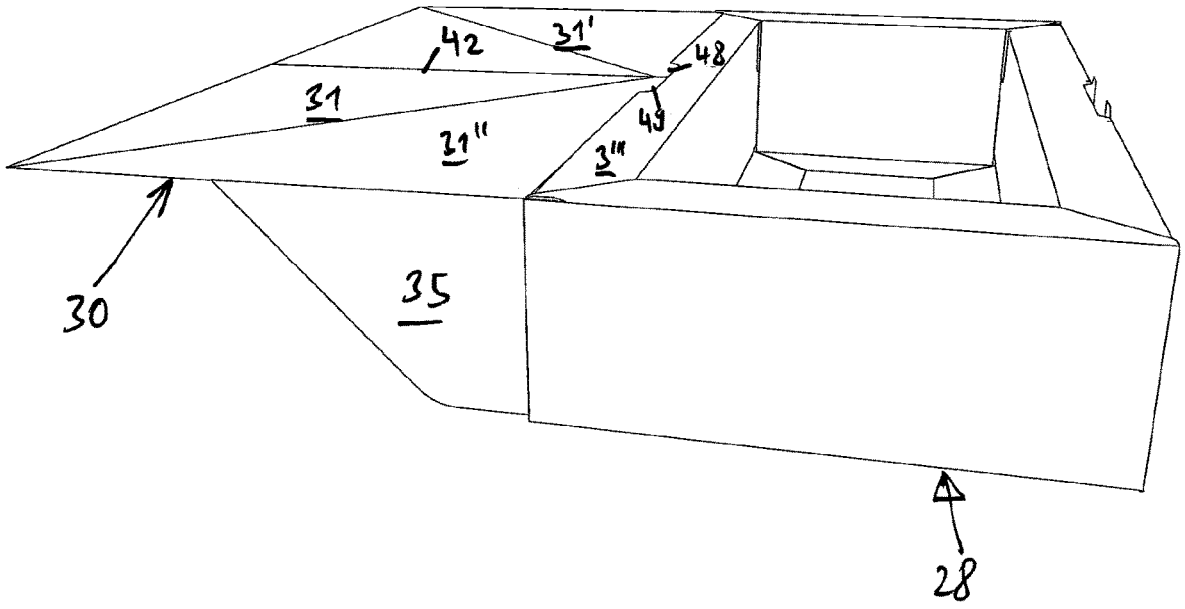
FIG. 15 illustrates a side perspective view of an embodiment of the folding carton with the lid in art open state.

Alternatively, the lid 30 can be opened by folding the tuck-in tongue 44 under the top wall 31 and then folding the two top wall halves $31^{I}$, $31^{II}$ toward one another about the fourth fold line 45 and outward about the vertical first fold lines 36, 37. This is shown in FIGS. 13 and 14. These figures show that, in this opening method, the top wall halves $31^{I}$, $31^{II}$ are partially folded together along the respective diagonal fold lines 46, 47. However, at the end of the opening process, the two top wall halves $31^{I}$, $31^{II}$ are both horizontal again. In the open state, according to FIG. 15, the two top wall halves $31^{I}$, $31^{II}$ abut one another by the respective portions of the second edge 42 of the top wall 31. Furthermore, the support tabs 48, 49 rest on the upper side of an upper side wall part $3^{III}$ and support the top wall 31 in the open position. Subsequently, the lid 30 can be closed again by carrying out the opening movement in the opposite direction.

The invention claimed is:

1. A folding carton comprising:

a tray including a base wall and side wall; and a lid including a top wall configured to at least partially cover the tray, the lid further comprises, two connection tabs configured to connect to at least one side wall of the tray, two corner connection tabs that are each configured to connect to one of the two connection tabs via a vertical first fold line and configured to connect to a first edge of the top wall via a horizontal second fold line, a separation line that extends perpendicularly to the first edge of the top wall and divides the top wall into two top wall halves, and a tuck-in tongue connected to a second edge of the top wall opposite the first edge via a third fold line, wherein the tuck-in tongue spans the separation line is divided into two, tuck-in tongue halves by a fourth fold line that extends in continuation of the separation line, wherein the top wall is configured to be opened by one of: (1) folding about the horizontal second fold lines between the corner connection tabs and the top wall; and (2) by folding the tuck-in tongue about the third fold line against an inside of the top wall and folding the top wall halves about the fourth fold line in the tuck-in tongue and about the vertical first fold lines between the corner connection tabs and the connection tabs.

2. The folding carton according to claim 1, wherein the top wall halves each comprise a diagonal fold line that extends from an end of the separation line in the first edge of the top wall to an outer end of the second edge of the top wall.

3. The folding carton according to claim 1, wherein the connection tabs are configured to be inserted into parallel first insertion slots on outer ends of a side wall of the tray.

4. The folding carton according to claim 1, wherein the connection tabs lie against two parallel side walls of the tray.

5. The folding carton according to claim 1, wherein the connection tabs are trapezoidal, and wherein a height of the connection tabs decreases with increasing distance from the vertical first fold lines.

6. The folding carton according to claim 1, wherein the corner connection tabs comprise a right-angled trapezoid shape, wherein the horizontal second fold lines transition into the side walls of the right-angle trapezoid, and wherein the vertical first fold lines transition into limbs of the right-angled trapezoid that extend perpendicularly to the side walls.

7. The folding carton according to claim 1, wherein the tuck-in tongue of the lid is configured to be inserted into a second insertion slot on an upper edge of a side wall of the tray.

8. The folding carton according to claim 1, wherein the tuck-in tongue comprises an isosceles trapezoid shape, and wherein a width of the tuck-in tongue decreases away from the second edge of the top wall.

9. The folding carton according to claim 1, wherein the tray is a buffer-wall tray.

10. The folding carton according to claim 3, wherein the first insertion slots are each formed on a fold line between a dust flap, a side wall, and another side wall that is folded against the dust flap.

11. The folding carton according to claim 7, wherein the second insertion slot is formed on a fold line between an outer side wall part and a horizontal upper side wall part of a buffer-wall tray.

12. The folding carton according to claim 11, wherein the buffer-wall tray comprises a thumb hole adjoining the second insertion slot in an outer side wall part.

13. The folding carton according to claim 1, wherein the top wall comprises support tabs configured to project outward on two lateral edges and adjoin the second edge, and wherein the support tabs are positioned between both connection tabs on an upper edge of the tray when the top wall is opened.

14. The folding carton according to claim 1, further comprising inner side wall parts comprising base tabs on the lower edges that are configured to be supported on the base wall.

15. The folding carton according to claim 14, wherein each of the base tabs project inward relative to the inner side wall parts and comprise bevels at both ends, and wherein adjacent base tabs are configured to be supported against one another by the bevels.

* * * * *